US010682851B2

(12) United States Patent
Sato et al.

(10) Patent No.: US 10,682,851 B2
(45) Date of Patent: Jun. 16, 2020

(54) LIQUID EJECTION APPARATUS

(71) Applicant: BROTHER KOGYO KABUSHIKI KAISHA, Nagoya-shi, Aichi-ken (JP)

(72) Inventors: Shoji Sato, Okazaki (JP); Satoru Arakane, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/171,674

(22) Filed: Oct. 26, 2018

(65) Prior Publication Data

US 2019/0126613 A1 May 2, 2019

(30) Foreign Application Priority Data

Nov. 2, 2017 (JP) ..... 2017-213050

(51) Int. Cl.

| | |
|---|---|
| ***B41J 2/045*** | (2006.01) |
| ***B41J 11/42*** | (2006.01) |
| ***B41J 29/38*** | (2006.01) |
| ***B41J 11/00*** | (2006.01) |
| ***B41J 13/00*** | (2006.01) |
| ***B41J 2/21*** | (2006.01) |

(52) U.S. Cl.

CPC ..... *B41J 2/04556* (2013.01); *B41J 2/04553* (2013.01); *B41J 2/2135* (2013.01); *B41J 11/0065* (2013.01); *B41J 11/0095* (2013.01); *B41J 11/42* (2013.01); *B41J 13/0027* (2013.01); *B41J 29/38* (2013.01); *B41J 11/008* (2013.01)

(58) Field of Classification Search

CPC .... B41J 2/04556; B41J 2/04553; B41J 29/38; B41J 11/0065; B41J 11/0095; B41J 11/42; B41J 11/008

See application file for complete search history.

(56) References Cited

U.S. PATENT DOCUMENTS 8,167,394 B2 * 5/2012 Terada ..... B41J 11/0095 347/19
9,016,828 B2 * 4/2015 Yatsunami ..... B41J 29/393 347/19

FOREIGN PATENT DOCUMENTS

| | | |
|---|---|---|
| JP | 2002-036525 A | 2/2002 |
| JP | 2005-081750 A | 3/2005 |
| JP | 2010-173150 A | 8/2010 |
| JP | 2012-131138 A | 7/2012 |

* cited by examiner

*Primary Examiner* — Thinh H Nguyen
(74) *Attorney, Agent, or Firm* — Scully, Scott, Murphy & Presser, P.C.

(57) ABSTRACT

A controller is configured to receive an output signal outputted from a light reception element. The controller is configured to perform: an existence detection of controlling a light emission element to emit light and detecting whether an ejection target exists at a facing position based on the output signal; and a distance detection of controlling the light emission element to emit light toward a surface of the ejection target and detecting a distance between the surface of the ejection target and a nozzle surface based on the output signal outputted from the light reception element upon receiving light reflected off the surface of the ejection target. An amount of change of the output signal with respect to change of the distance in the distance detection is larger than an amount of change of the output signal with respect to change of the distance in the existence detection.

18 Claims, 9 Drawing Sheets

| | |
|---|---|
| FIRST SCAN OPERATION | DISTANCE DETECTION |
| SECOND SCAN OPERATION | SIDE EDGE DETECTION |
| THIRD SCAN OPERATION | DISTANCE DETECTION |
| FOURTH SCAN OPERATION | DISTANCE DETECTION |
| FIFTH SCAN OPERATION | SIDE EDGE DETECTION |
| SIXTH SCAN OPERATION | DISTANCE DETECTION |
| SEVENTH SCAN OPERATION | DISTANCE DETECTION |
| — | — |
| — | — |

LIQUID EJECTION APPARATUS

CROSS REFERENCE TO RELATED APPLICATIONS

This application claims priority from Japanese Patent Application No. 2017-213050 filed Nov. 2, 2017. The entire content of the priority application is incorporated herein by reference.

TECHNICAL FIELD

This disclosure relates to a liquid ejection apparatus.

BACKGROUND

A problem is known in which when an ejection target makes contact with a nozzle surface, a nozzle formed on the nozzle surface is damaged, and in which thus the ejection performance of a liquid from the nozzle is degraded. It is disclosed that in order for the problem described above to be suppressed, when the floating of the ejection target is detected with a sensor, the nozzle surface is covered with a shutter so as to be protected, whereby the ejection target is prevented from making contact with the nozzle surface.

SUMMARY

According to one aspect, this specification discloses a liquid ejection apparatus. The liquid ejection apparatus includes a liquid ejection head, a conveyer, an optical sensor, and a controller. The liquid ejection head has a nozzle surface formed with a nozzle configured to eject liquid. The conveyer is configured to convey an ejection target in a conveyance direction along a conveyance path including a facing position facing the nozzle surface. The optical sensor includes a light emission element configured to emit light and a light reception element configured to output an output signal based on received light. The controller is configured to receive the output signal outputted from the light reception element. The controller is configured to perform: an existence detection of controlling the light emission element to emit light and detecting whether the ejection target exists at the facing position based on the output signal; and a distance detection of controlling the light emission element to emit light toward a surface of the ejection target and detecting a distance between the surface of the ejection target and the nozzle surface based on the output signal outputted from the light reception element upon receiving light reflected off the surface of the ejection target. An amount of change of the output signal with respect to change of the distance in the distance detection is larger than the amount of change of the output signal with respect to change of the distance in the existence detection.

BRIEF DESCRIPTION OF THE DRAWINGS

Embodiments in accordance with this disclosure will be described in detail with reference to the following figures wherein.

DETAILED DESCRIPTION

In the disclosure described above, a special sensor is used for distance detection in which the floating (that is, a distance between the surface of the ejection target and the nozzle surface) of the ejection target is detected. On the other hand, a technology is known in which in a liquid ejection apparatus, existence detection is performed for detecting whether the ejection target exists in a facing position facing the nozzle surface, and in which based on the result of the existence detection, ejection control on the liquid from the nozzle is performed. When the existence detection is performed with the sensor described above, since the sensor is set appropriate for the distance detection, it is likely that the existence detection is prevented from being performed accurately. In other words, when the sensor described above is used, unless some kind of method is devised, both the existence detection and the distance detection cannot be performed accurately.

An example of an object of this disclosure is to provide a liquid ejection apparatus which uses a sensor so as to accurately perform both existence detection and distance detection.

First Embodiment

Figure 1:
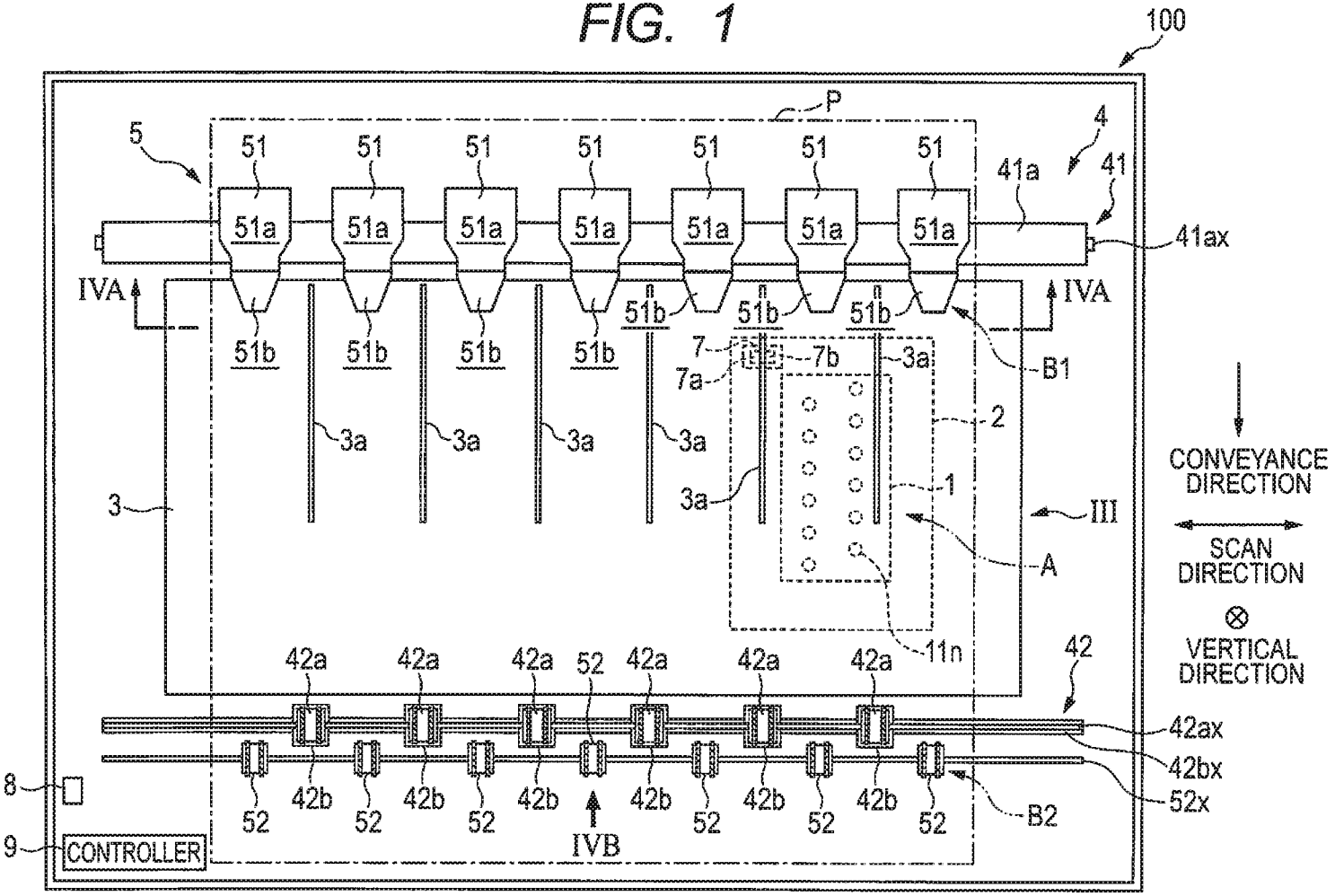
FIG. 1 is a plan view of a printer according to a first embodiment of this disclosure.

As shown in FIG. 1, a printer 100 according to a first embodiment of this disclosure includes a head 1, a carriage 2, a platen 3, a conveyer 4, a wave-shape imparting mechanism 5, an optical sensor 7, a temperature sensor 8, and a controller 9.

The head 1 is a serial type, and is mounted on the carriage 2, and is configured to reciprocate together with the carriage 2 in a scan direction (perpendicular direction perpendicular to the conveyance direction). The carriage 2 is supported by a carriage movement mechanism (not illustrated). When a carriage motor 25 (refer to FIG. 5) is driven by control of the controller 9, the carriage movement mechanism is driven and the carriage 2 moves in the scan direction while supporting the head 1.

Figure 2:
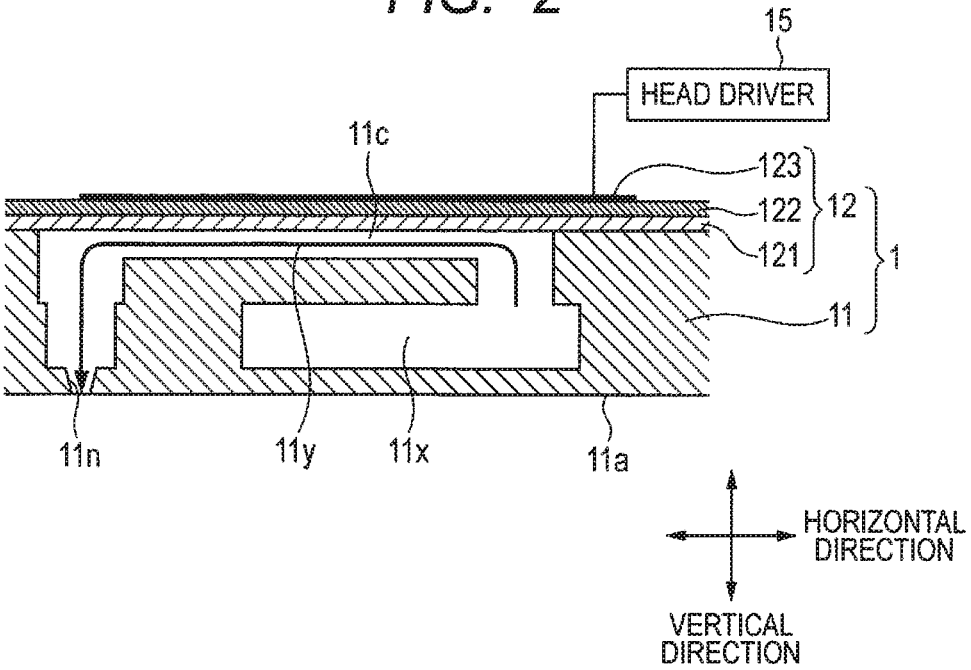
FIG. 2 is a partial sectional view of a head included in the printer according to the first embodiment of this disclosure.

As shown in FIG. 2, the head 1 includes a channel unit 11 and an actuator unit 12. A lower surface of the channel unit 11 is a nozzle surface 11*a* on which a plurality of nozzles 11*n* are formed. Inside the channel unit 11, a common channel 11*x* communicating with an ink tank (not illustrated) and individual channels 11*y* individually provided for the respective nozzles 11*n* are formed. The individual channels 11*y* are channels from an outlet of the common channel 11*x* to the nozzles 11*n* through pressure chambers 11*c*. In an upper surface of the channel unit 11, a plurality of pressure chambers 11*c* is opened. The actuator unit 12 includes a vibration plate 121 disposed on an upper surface of the channel unit 11 so as to cover the plurality of pressure chambers 11*c*, a piezoelectric layer 122 disposed on an upper surface of the vibration plate 121, and a plurality of individual electrodes 123 disposed on an upper surface of the piezoelectric layer 122 so as to respectively face the plurality of pressure chambers 11*c*. In the vibration plate 121 and the piezoelectric layer 122, portions sandwiched by the respective individual electrodes 123 and the respective pressure chambers 11*c* function as individual unimorph actuators for each pressure chamber 11*c*, and independently deformable according to application of a voltage by a head driver 15 to each individual electrode 123. By deformation of the actuator so as to become convex toward the pressure chamber 11*c*, a volume of the pressure chamber 11*c* decreases, ink inside the pressure chamber 11*c* is pressurized, and the ink is ejected from the nozzle 11*n*.

Figure 3:
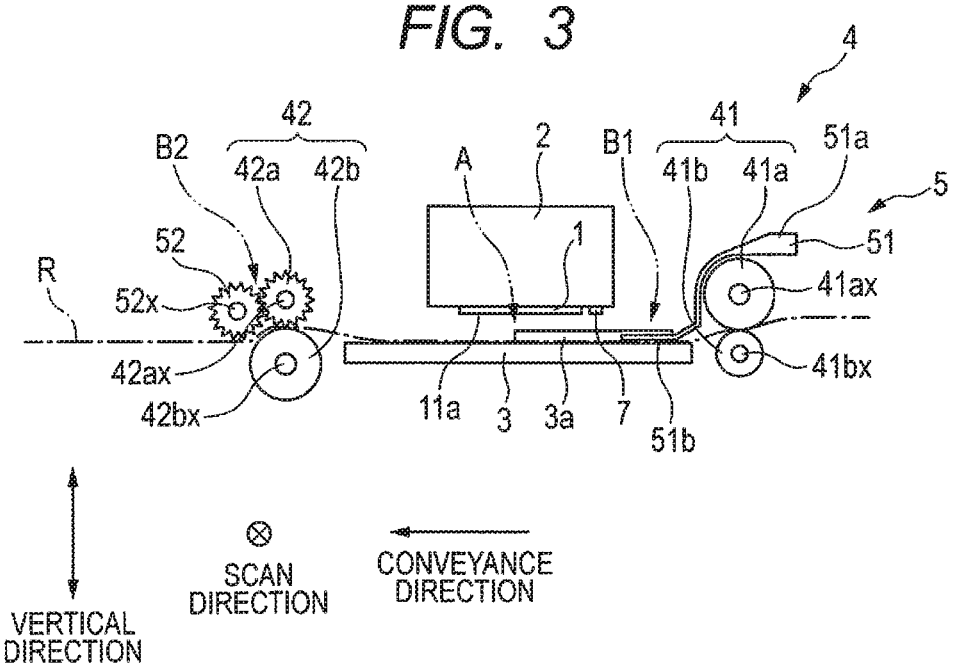
FIG. 3 is a side view of the printer according to the first embodiment of this disclosure, viewed from the direction of the arrow III in FIG. 1.

As shown in FIG. 3, the platen 3 is disposed below the head 1 and the carriage 2. On a surface of the platen 3, a paper P is supported.

As shown in FIG. 1, the conveyer 4 includes an upstream roller pair 41 disposed upstream of the head 1 in the conveyance direction, and downstream roller pairs 42 disposed downstream of the head 1 in the conveyance direction.

As shown in FIG. 3, the upstream roller pair 41 includes an upper roller 41*a* and a lower roller 41*b*. Both of the upper roller 41*a* and the lower roller 41*b* are long in the scan direction, and are disposed one above the other so that their circumferential surfaces come into contact with each other. The upper roller 41*a* and the lower roller 41*b* are respectively supported by shafts 41*ax* and 41*bx* extending in the scan direction, and rotatable around the shafts 41*ax* and 41*bx*.

As shown in FIG. 1, the downstream roller pairs 42 include six upper rollers 42*a* and six lower rollers 42*b*. Each one of the upper rollers 42*a* and each one of the lower rollers 42*b* are paired and disposed one above the other so that their circumferential surfaces come into contact with each other. That is, the downstream roller pairs 42 include six pairs each consisting of one upper roller 42*a* and one lower roller 42*b*. The six pairs are arranged at even intervals in the scan direction. The six upper rollers 42*a* are supported by a shaft 42*ax* extending in the scan direction, and rotatable around the shaft 42*ax*. The six lower rollers 42*b* are supported by a shaft 42*bx* extending in the scan direction, and rotatable around the shaft 42*bx*.

When a conveyance motor 45 (refer to FIG. 5) is driven by control of the controller 9, one of the upper roller and the lower roller of each roller pair 41, 42 is driven, and the other one of the upper roller and the lower roller of each roller pair 41, 42 follows. Then, by rotating the upper rollers and the lower rollers of the respective roller pairs 41 and 42 while sandwiching the paper P, the paper P is conveyed in the conveyance direction along a conveyance path R (refer to FIG. 3) including a facing position A on the surface of the platen 3 facing the nozzle surface 11*a* so as to pass through the facing position A. The conveyance path R extends from a paper feed tray (not illustrated) to a discharge tray (not illustrated) through the facing position A.

The upper roller 41*a* and the lower roller 41*b* of the upstream roller pair 41 and the lower rollers 42*b* of the downstream roller pairs 42 are rubber rollers having no projection formed on an outer circumferential surface, however, the upper rollers 42*a* of the downstream roller pairs 42 are spur rollers each having a plurality of projections formed on an outer circumferential surface. Accordingly, ink that has landed on a surface of the paper P does not tend to attach to the upper rollers 42*a*.

As shown in FIG. 1, the wave-shape imparting mechanism 5 includes seven corrugation plates 51, six ribs 3*a* formed on the surface of the platen 3, seven corrugation spurs 52, and six pairs each consisting of one upper roller 42*a* and one lower roller 42*b* in the downstream roller pairs 42.

The seven corrugation plates 51 press the surface of the paper P at a pressing position B1 set upstream of the head 1 in the conveyance direction and downstream of the upstream roller pair 41 in the conveyance direction. As shown in FIG. 1, the seven corrugation plates 51 are arranged at even intervals in the scan direction. As shown in FIG. 3, each corrugation plate 51 includes a base portion 51*a* provided above the upper roller 41*a* of the upstream roller pair 41, and a pressing portion 51*b* extending downstream from the base portion 51*a* in the conveyance direction and facing a surface of an upstream portion of the platen 3 in the conveyance direction. The pressing portion 51*b* faces the surface of the platen 3 through a slight gap.

As shown in FIG. 1, the six ribs 3*a* are arranged at even intervals in the scan direction and respectively disposed between corrugation plates 51 adjacent to each other in the scan direction. Each rib 3*a* extends in the conveyance direction. Positions in the scan direction of the six ribs 3*a* respectively match positions in the scan direction of the pairs each consisting of one upper roller 42*a* and one lower roller 42*b*.

Figure 4A:
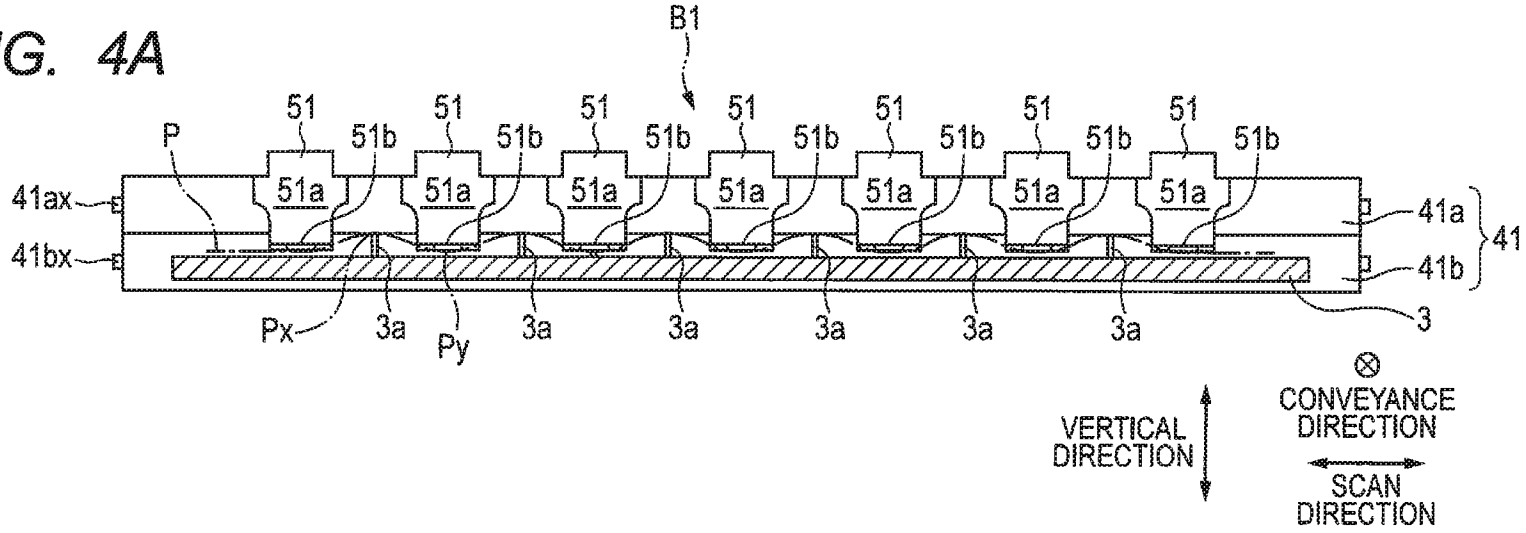
FIG. 4A is a sectional view taken along line IVA-IVA in FIG. 1.

As shown in FIG. 4A, an upper end of each rib 3*a* is positioned higher than the pressing portion 51*b* of each corrugation plate 51. In this positional relationship, by supporting the paper P by the upper ends of the six ribs 3*a* from below and pressing the paper P by the pressing portions 51*b* of the seven corrugation plates 51 from above, a wave-shape along the scan direction is imparted to the paper P. In detail, a wave-shape including a plurality of mountain portions Px close to the nozzle surface 11*a* and a plurality of valley portions Py farther spaced from the nozzle surface 11*a* than the mountain portions Px, respectively arranged along the scan direction, is imparted to the paper P.

The seven corrugation spurs 52 press the surface of the paper P at a pressing position B2 set downstream of the head 1 in the conveyance direction. As shown in FIG. 1, the seven corrugation spurs 52 are disposed downstream of the downstream roller pairs 42 in the conveyance direction. The seven corrugation spurs 52 are arranged at even intervals in the scan direction, and their positions in the scan direction respectively match positions in the scan direction of the seven corrugation plates 51. Between the corrugation spurs 52 adjacent to each other in the scan direction, pairs each consisting of one upper roller 42*a* and one lower roller 42*b* are respectively disposed. The seven corrugation spurs 52 are supported by a shaft 52*x* extending in the scan direction, and are rotatable around the shaft 52*x*.

Figure 4B:
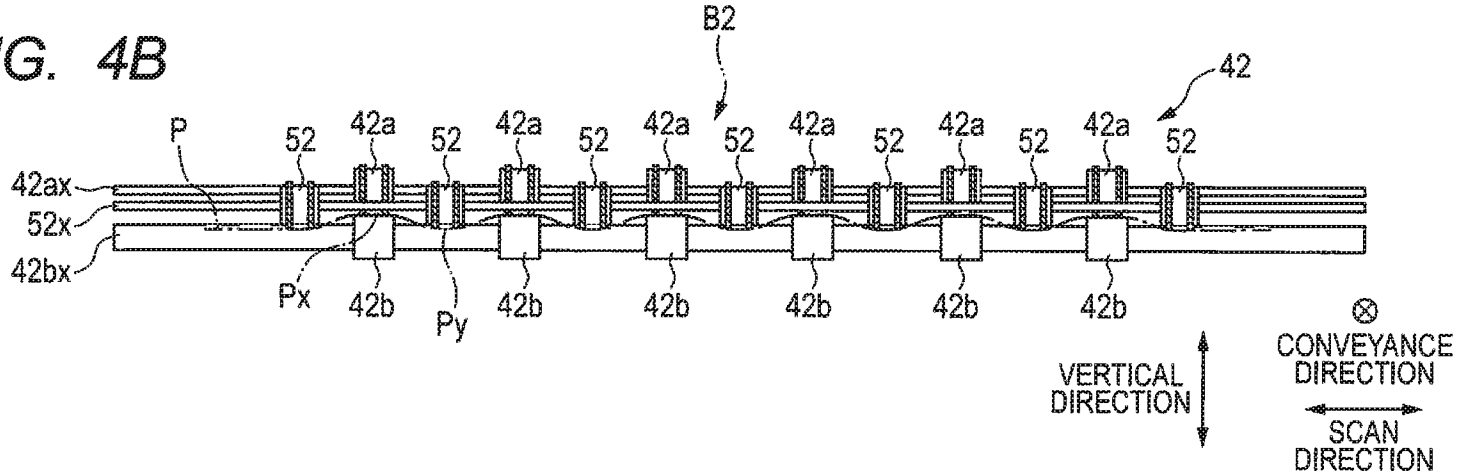
FIG. 4B is a side view viewed from the direction of the arrow IVB in FIG. 1.

As shown in FIG. 4B, a contact point between the upper roller 42*a* and the lower roller 42*b* is positioned higher than the lower end of the corrugation spur 52. In this positional relationship, the six lower rollers 42*b* support the paper P from below, and the seven corrugation spurs 52 press the paper P from above, and accordingly, a wave-shape along the scan direction is imparted to the paper P. In detail, a wave-shape including a plurality of mountain portions Px and a plurality of valley portions Py respectively arranged along the scan direction, similar to the wave-shape (refer to FIG. 4A) imparted at the pressing position B1, is imparted to the paper P.

By imparting the wave-shape along the scan direction to the paper P by the wave-shape imparting mechanism 5, the paper P is provided with stiffness, and excellent conveyance is realized.

As shown in FIG. 1, the optical sensor 7 is mounted on the carriage 2, and disposed upstream of the head 1 in the conveyance direction and at one side of the scan direction. The optical sensor 7 is used both for existence detection to detect whether the paper P exists at the facing position A and for distance detection to detect a distance between the surface of the paper P and the nozzle surface 11*a*. The optical sensor 7 is a reflective optical sensor, and includes a light emission element 7*a* and a light reception element 7*b*. The light emission element 7*a* emits light by control of the controller 9. Light emitted by the light emission element 7*a* is reflected off the surface of the platen 3 or the surface of the paper P. The light reception element 7*b* receives light reflected on the surface of the platen 3 or the surface of the paper P, and outputs an output signal based on the light.

Ink to be ejected from the nozzles 11*n* is not a pigment ink, but a dye ink. In the case of a pigment ink, a difference in reflected light amount between a region in which the ink is landed and a region in which the ink is not landed on the paper P is large, and it becomes difficult to perform distance detection during recording. On the other hand, in the case of a dye ink, the above-described difference is smaller than in the case of a pigment ink, and it is possible to perform distance detection during recording.

As shown in FIG. 1, the temperature sensor 8 is disposed within a casing of the printer 100, and outputs a temperature signal indicative of an ambient temperature around the head 1.

Figure 5:
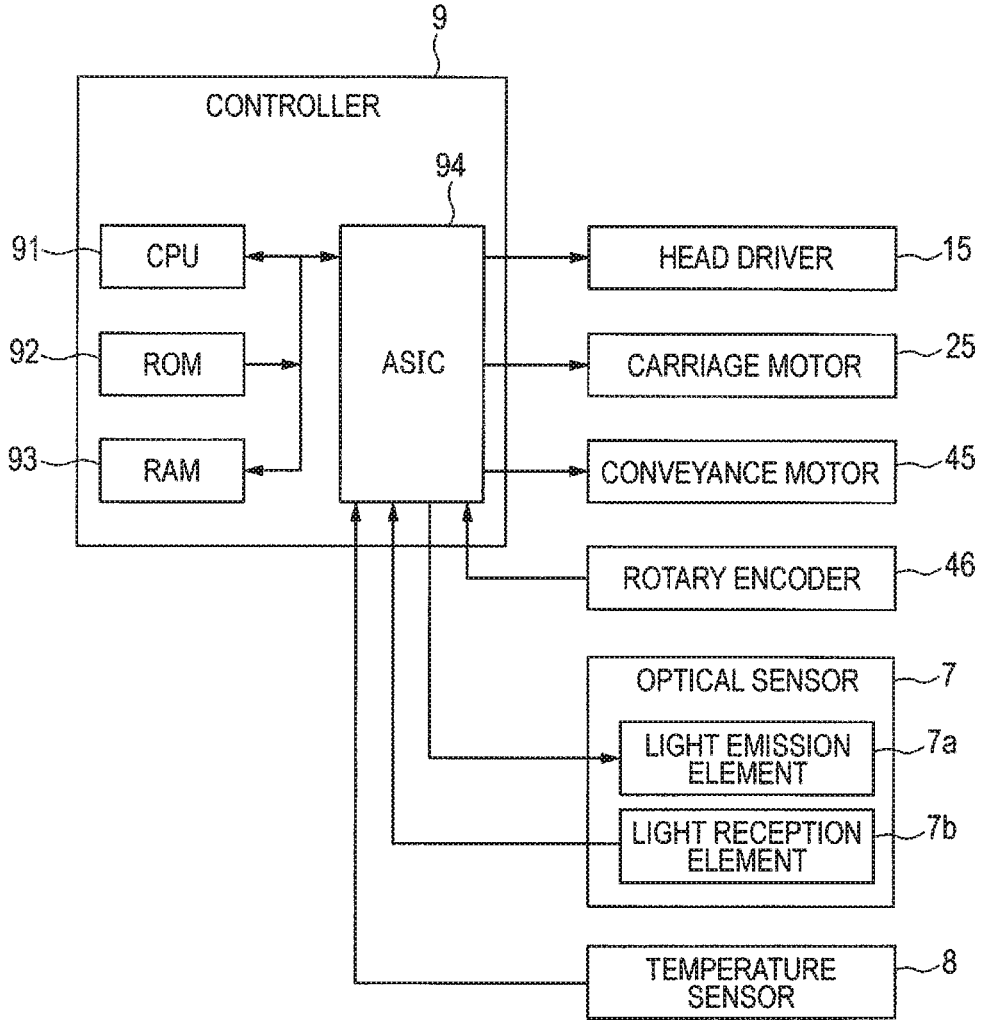
FIG. 5 is a block diagram showing an electrical configuration of the printer according to the first embodiment of this disclosure.

As shown in FIG. 5, the controller 9 includes a CPU (Central Processing Unit) 91, a ROM (Read Only Memory) 92, a RAM (Random Access Memory) 93, and an ASIC (Application Specific Integrated Circuit) 94 including various control circuits. The controller 9 is connected to an external apparatus such as a PC to perform data communication.

In the ROM 92, programs and data to be used by the CPU 91 to control various operations are stored. The RAM 93 temporarily stores data to be used by the CPU 91 to execute the above-described programs. The CPU 91 issues a command to the ASIC 94 according to programs and data stored in the ROM 92 and the RAM 93 based on a recording command input from an external apparatus. The CPU 91 and the ASIC 94 are examples of "controller."

The head driver 15, the carriage motor 25, and the conveyance motor 45 are connected to the ASIC 94. According to a command from the CPU 91, the ASIC 94 controls the head driver 15, the carriage motor 25, and the conveyance motor 45 to alternately perform a conveyance operation to convey the paper P by a particular distance in the conveyance direction by the conveyer 4, and a scan operation to eject ink from the nozzles 11*n* while moving the carriage 2 in the scan direction. Accordingly, on the surface of the paper P, ink dots are formed and an image is recorded.

A rotary encoder 46 that outputs a signal showing a number of rotations of the conveyance motor 45 is further connected to the ASIC 94. The ASIC 94 receives a signal output from the rotary encoder 46, and transfers this signal to the CPU 91. The CPU 91 detects a position of the paper P in the conveyance path R based on the signal.

The optical sensor 7 and the temperature sensor 8 are further connected to the ASIC 94. According to a command from the CPU 91, the ASIC 94 inputs an input signal into the light emission element 7*a* to irradiate light from the light emission element 7*a*. In addition, the ASIC 94 receives an output signal output from the light reception element 7*b* and a temperature signal output from the temperature sensor 8 and transfers these signals to the CPU 91. The CPU 91 performs existence detection and distance detection based on the output signal from the light reception element 7*b*.

Here, input-output characteristics of the optical sensor 7 are described with reference to FIG. 6.

Figure 6:
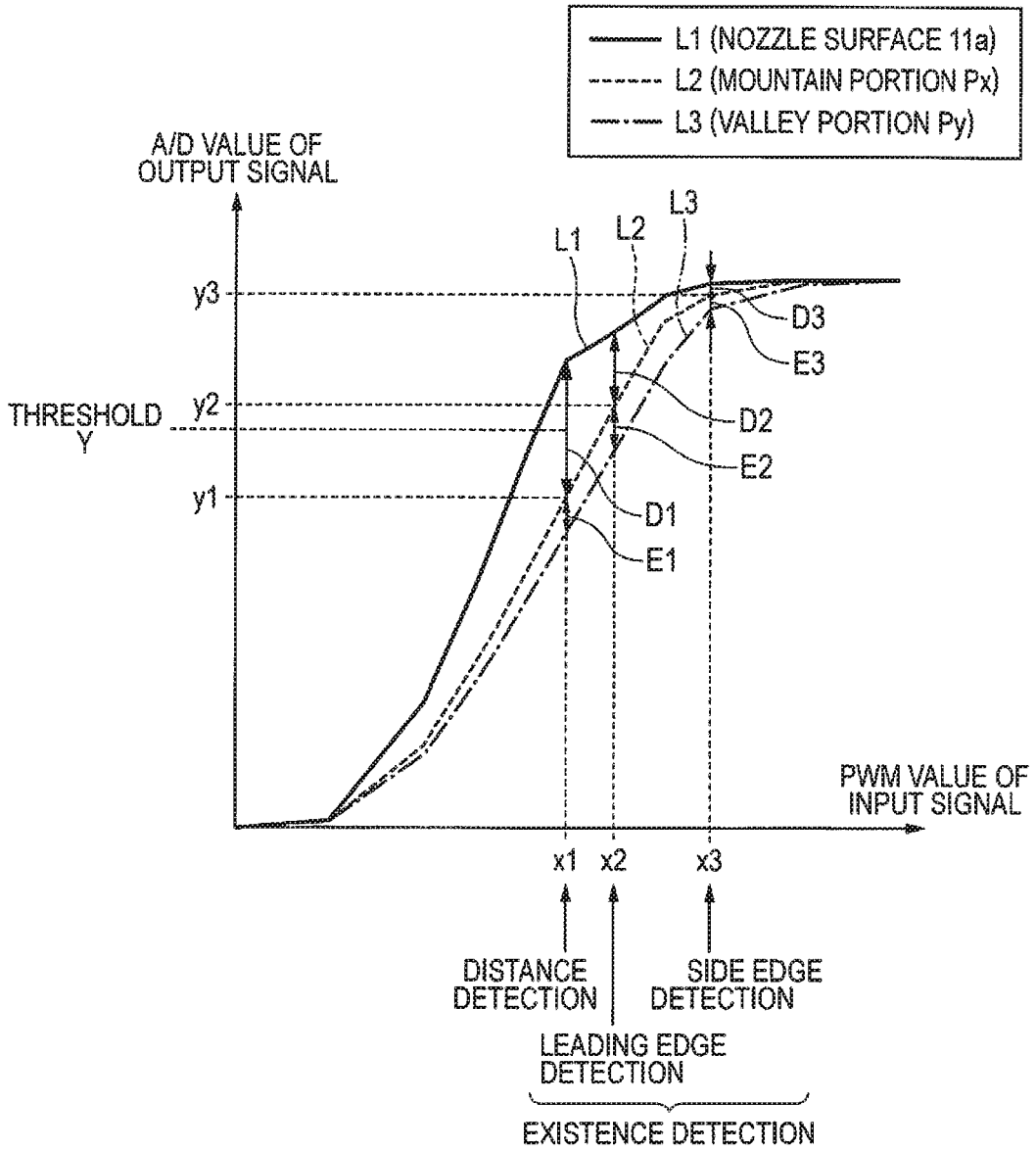
FIG. 6 is a graph showing an example of input-output characteristics of an optical sensor according to the first embodiment of this disclosure.

In FIG. 6, the horizontal axis represents a PWM (Pulse Width Modulation) value of an input signal to be input into the light emission element 7*a*, and the vertical axis represents an A/D (Analog/Digital) value of an output signal to be output from the light reception element 7*b*. A light emission amount being an amount of light emitted by the light emission element 7*a* is in proportion to the PWM value of the input signal, and the light emission amount increases as the PWM value increases. The CPU 91 and the ASIC 94 are configured so as to change the light emission amount by changing the PWM value of the input signal to be input into the light emission element 7*a*.

The curves L1 to L3 in FIG. 6 show relationships between the PWM value of the input signal and the A/D value of the output signal when the light emission element 7*a* irradiates light toward the surface of the paper P in response to the input signal and the light reception element 7*b* receives light reflected on the surface of the paper P and outputs the output signal, on condition that a paper P of a standard kind is used and a height of the surface of the paper P is set to the heights of the nozzle surface 11*a*, the mountain portion Px, and the valley portion Py, respectively. In the order of the nozzle surface 11*a*, the mountain portion Px, and the valley portion Py, the height in the vertical direction becomes lower, and a distance between the surface of the paper P and the nozzle surface 11*a* (referred to as "paper-nozzle distance") when the paper P is located at the height becomes longer. In FIG. 6, at the same PWM value, the A/D value decreases as the paper-nozzle distance increases (that is, in the order of the curve L1, the curve L2, and the curve L3).

To perform accurate distance detection, an amount of change in output signal caused by a difference in height of the surface of the paper P (that is, in response to a change in distance between the surface of the paper P and the nozzle surface 11*a*) is preferably large. A large amount of change in output signal with respect to a distance change means high sensitivity of distance detection. In the present embodiment, a PWM value when the difference (amount of change) in A/D value between the curves L1 and L2 becomes a maximum D1 is defined as an input reference value x1 for distance detection, and the A/D value of the curve L2 at this time is defined as an output reference value y1 for distance detection. In addition, an intermediate value of the A/D values of the curves L1 and L2 is defined as a threshold Y.

In order to accurately perform the existence detection, it is preferable that the amount of change in the output signal caused by the existence and absence of the paper P is large, and that the amount of change in the output signal caused by a difference in the height of the paper P is small. The existence detection includes: leading edge detection for detecting whether the leading edge (downstream end in the conveyance direction) of the paper P exists at the facing position A; and side edge detection for detecting whether a side edge (end portion in the scan direction) of the paper P exists at the facing position A. In the present embodiment, a PWM value when a difference (amount of change) between the A/D values in the curves L1 and L2 is D2 (approximately half of D1) is assumed to be an input reference value x2 for the leading edge detection, and the A/D value in the curve L2 at this time is assumed to be an output reference value y2 for the leading edge detection. The PWM value when the difference (amount of change) between the A/D values in the curves L1 and L2 is D3 (<D2) is assumed to be an input reference value x3 for the side edge detection, and the A/D value in the curve L2 at this time is assumed to be an output reference value y3 for the side edge detection. A difference (amount of change) between the A/D values in the curves L2 and L3 at the input reference value x3 for the side edge detection is smaller than a difference (amount of change) E1 between the A/D values in the curves L2 and L3 at the input reference value x1 for the distance detection and a difference (amount of change) E2 between the A/D values in the curves L2 and L3 at the input reference value x2 for the leading edge detection.

The data in FIG. 6 is based on characteristics unique to each optical sensor 7, and are obtained by actual measurement in the manufacturing process of the printer 100. Among these data, the input reference value x2, the output reference values y1 to y3 and the threshold Y are stored in the ROM 92 in the manufacturing process of the printer 100. The input reference value x2 is used in S4 and S5 described later. The output reference values y1 to y3 are used in S8 and S9 (first determination processing) and S10 (second determination processing) described later. The output reference values y2 and y3 are examples of "first output reference value", and the output reference value y1 is an example of "second output reference value". The threshold Y is used for determination as to whether to interrupt image recording, together with results of distance detection.

Next, control details relating to recording are described with reference to FIG. 7.

First, the CPU 91 determines whether it has received a recording command from an external apparatus (S1). When the CPU 91 does not receive a recording command (S1: NO), the processing of S1 is repeated. When it receives a recording command (S1: YES), the CPU 91 controls the conveyance motor 45 through the ASIC 94 to start conveyance of the paper P (S2).

After S2, the CPU 91 determines whether a leading edge of the paper P has reached the upstream roller pair 41 based on a signal of the rotary encoder 46 transferred from the ASIC 94 (S3). When the leading edge of the paper P does not reach the upstream roller pair 41 (S3: NO), the processing of S3 is repeated. When the leading edge of the paper P reaches the upstream roller pair 41 (S3: YES), the CPU 91 controls the carriage motor 25 through the ASIC 94 to start movement of the carriage 2 and inputs, to the light emission element 7*a*, an input signal with the PWM value set to the input reference value x2 for leading edge detection, through the ASIC 94, to start light emission of the light emission element 7*a* (S4).

After S4, the CPU 91 performs the leading edge detection based on the output signal from the light reception element 7*b* (S5). When the A/D value of the output signal is increased by a particular value (threshold) or more, the CPU 91 detects that the leading edge of the paper P exists at the facing position A. When the CPU 91 detects that the leading edge of the paper P does not exist at the facing position A (S5: NO), the processing in S5 is repeated. When the CPU 91 detects that the leading edge of the paper P exists at the facing position A (S5: YES), the CPU 91 controls the conveyance motor 45 through the ASIC 94 so as to stop the conveyance of the paper P (S6).

After S6, the CPU 91 controls the carriage motor 25 through the ASIC 94 so as to dispose the carriage 2 at a position (see FIG. 1) at which the optical sensor 7 faces the mountain portion Px (S7).

After S7, the CPU 91 determines an input setting value for the leading edge detection (S8). Specifically, the CPU 91 changes, through the ASIC 94, the PWM value of the input signal which is input to the light emission element 7*a*, and determines, as the input setting value for the leading edge detection, the PWM value of the input signal when the A/D value of the received output signal is the output reference value y2.

After S8, the CPU 91 determines an input setting value for the side edge detection (S9). Specifically, the CPU 91 changes, through the ASIC 94, the PWM value of the input signal which is input to the light emission element 7*a*, and determines, as the input setting value for the side edge detection, the PWM value of the input signal when the A/D value of the received output signal is the output reference value y3.

After S9, the CPU 91 determines an input setting value for the distance detection (S10). Specifically, the CPU 91 changes, through the ASIC 94, the PWM value of the input signal which is input to the light emission element 7*a*, and determines, as the input setting value for the distance detection, the PWM value of the input signal when the A/D value of the received output signal is the output reference value y1. Further, the CPU 91 receives a temperature signal from the temperature sensor 8 and stores the received temperature signal in the RAM 93.

Here, S8 and S9 correspond to the "first determination processing", and S10 corresponds to the "second determination processing". The input setting value for the leading edge detection determined in S8 and the input setting value for the side edge detection determined in S9 correspond to a "first input setting value", and the input setting value for the distance detection determined in S10 corresponds to a "second input setting value".

In S8 to S10, the CPU 91 controls the light emission element 7*a* to irradiate (emit) light to the surface of the mountain portion Px of a leading edge portion in the paper P. The light irradiated from the light emission element 7*a* is reflected off the surface of the mountain portion Px of the leading edge portion in the paper P, and enters the light reception element 7*b*. The light reception element 7*b* receives the light reflected off the surface of the mountain portion Px of the leading edge portion in the paper P and outputs the output signal based on the light. The CPU 91 determines each input setting value based on the output signal.

Each input setting value determined in S8 to S10 may be slightly different from the input reference values x1 to x3 in FIG. 6 depending on the type of paper P (properties such as the thickness and the existence of gloss). Although the input reference values x1 to x3 in FIG. 6 are values for the type of paper P which is the reference, in S8 to S10, the input setting values that are suitable for the paper P used for recording may be determined. Hence, preferably, when it is highly likely that the type of paper P is changed (such as when the power of the printer 100 is switched from OFF to ON or when the paper feed tray (unillustrated) is inserted or removed), preferably, S8 to S10 are thereafter performed before the recording on the first paper P.

After S10, the CPU 91 controls each part of the printer 100 such that recording is performed on one paper P (S11). The specific details of the control in S11 will be described later.

After S11, the CPU 91 determines whether recording needs to be performed on the subsequent paper P (S12). When image data which has not been recorded yet is left in the RAM 93, the CPU 91 determines that recording needs to be performed on the subsequent paper P (S12: YES). When image data which has not been recorded yet is not left in the RAM 93, the CPU 91 determines that recording does not need to be performed on the subsequent paper P (S12: NO), and the routine is finished.

When recording needs to be performed on the subsequent paper P (S12: YES), the CPU 91 determines whether a difference between an ambient temperature (environmental temperature) indicated by the temperature signal from the temperature sensor 8 received at this time and an ambient temperature indicated by the temperature signal from the temperature sensor 8 most recently received in S10 is larger than or equal to a particular temperature (S13). When the difference between the ambient temperatures is larger than or equal to the particular temperature (S13: YES), the CPU 91 returns the process to S6, determines again the input setting values (S8 to S10) and thereafter performs recording on the subsequent paper P in S11.

When the difference between the ambient temperatures is not larger than or equal to the particular temperature (S13: NO), the CPU 91 determines whether a difference between an A/D value of an output signal received this time and an A/D value of an output signal received at a previous time is larger than or equal to a particular value (S14). The A/D value of the output signal received this time is received when the leading edge detection is performed on the subsequent paper P by using the input setting value for the leading edge detection determined most recently in S8 as the PWM value of the input signal, and it is detected that the leading edge of the paper P exists at the facing position A. The A/D value of the output signal received at the previous time is received when it is detected in the leading edge detection performed on the most recently recorded paper P that the leading edge of the paper P exists at the facing position A, by using the input setting value for the leading edge detection determined most recently in S8 as the PWM value of the input signal. When the difference between the A/D values is larger than or equal to the particular value (S14: YES), the CPU 91 returns the process to S6, determines again the input setting values (S8 to S10) and thereafter performs the recording on the subsequent paper P in S11. When the difference between the A/D values is not larger than or equal to the particular value (S14: NO), the CPU 91 returns the process to S11, and performs the recording on the subsequent paper P without determining again the input setting values (that is, as each input setting value, the values determined most recently in S8 to S10 are used).

Figures 8, 9:
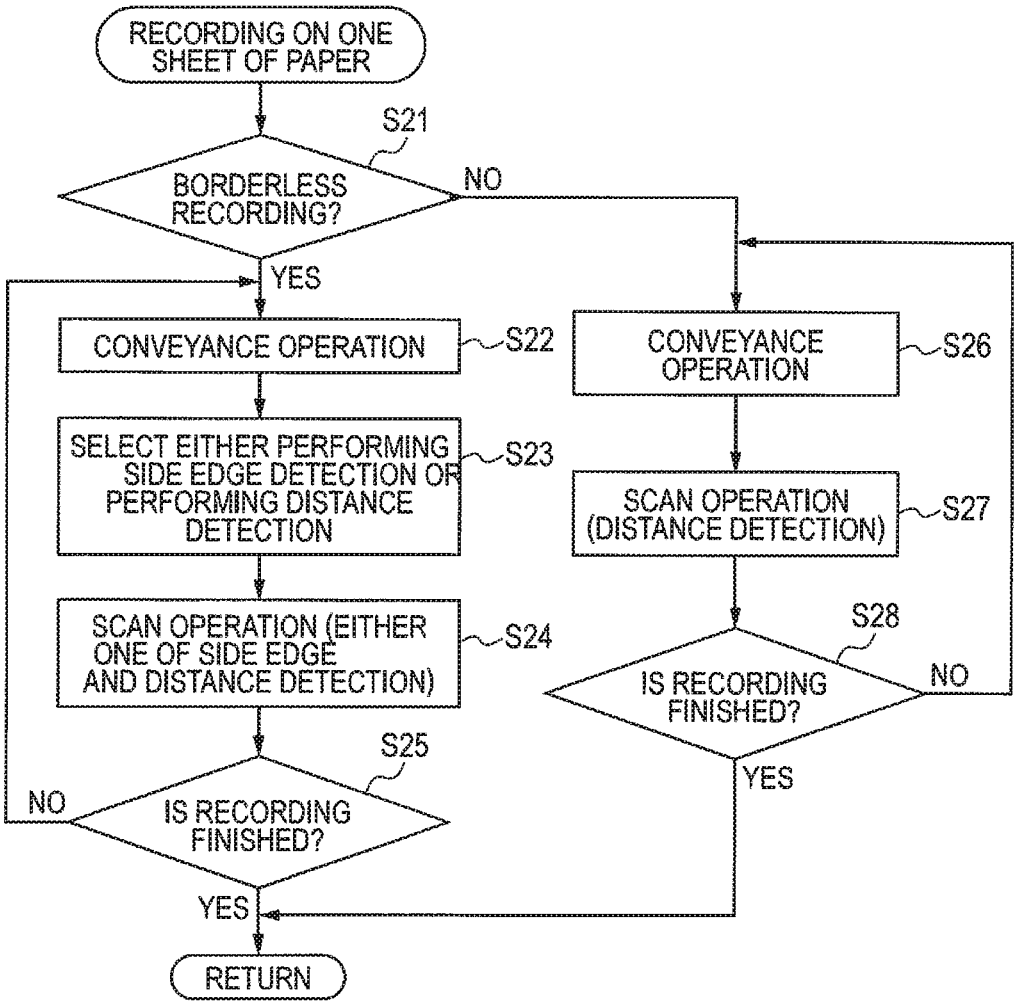
FIG. 8 is a flowchart showing control details in S11 of FIG. 7 (recording on one sheet of paper)
FIG. 9 shows an example of a table that is referred to during borderless recording.

Next, S11 (recording on one paper P) will be described with reference to FIG. 8.

The CPU 91 first determines whether the received recording command indicates "borderless recording (marginless recording)" (S21). The "borderless recording" means that no margin is provided in a region including the edge of the paper P and that the ink is ejected from the nozzle 11*n* so as to record the image. As the "borderless recording", there is a case where the ink is ejected to only the region including the edge of the paper P (the region inside the edge) and a case where the ink is ejected not only to the region including the edge of the paper P but also to a region near the edge of the paper P on the platen 3 (the region outside the edge). By contrast, "margined recording" means that a margin is provided in the region including the edge of the paper P and that the ink is not ejected from the nozzle 11*n* (the image is not recorded) in the margin. For example, when, in the recording command, a "photograph mode" and so on is specified, the CPU 91 may determine that the recording command indicates the "borderless recording".

When the received recording command indicates the "borderless recording" (S21: YES), the CPU 91 controls the conveyance motor 45 through the ASIC 94 to perform the conveyance operation for conveying the paper P the particular amount in the conveyance direction (S22).

After S22, the CPU 91 refers to a table (FIG. 9) that is stored in the ROM 92 so as to select which one of the side edge detection and the distance detection is performed (S23). In the table of FIG. 9, one of the side edge detection and the distance detection is associated with each scan. For example, the CPU 91 makes a selection such that in a first scan operation, the distance detection is performed, and that in a second scan operation, the side edge detection is performed.

After S23, the CPU 91 controls the head driver 15 and the carriage motor 25 through the ASIC 94 to perform a scan operation for ejecting the ink from the nozzle 11*n* while moving the carriage 2 in the scan direction (S24). In S24, the CPU 91 performs one of the side edge detection and the distance detection selected in S23 while performing control such that the scan operation is performed.

When the side edge detection is performed, the CPU 91 uses, as the PWM value of the input signal, the input setting value for the side edge detection determined most recently in S9. The CPU 91 performs ejection control on the ink from the nozzle 11*n* based on the result of the side edge detection.

When the distance detection is performed, the CPU 91 uses, as the PWM value of the input signal, the input setting value for the distance detection determined most recently in S10. The CPU 91 determines, based on the result of the distance detection, whether to interrupt image recording. Specifically, when the A/D value of the received output signal exceeds the threshold Y, the CPU 91 determines that image recording is to be interrupted. When image recording is to be interrupted, for example, the CPU 91 performs processing for controlling the conveyance motor 45 through the ASIC 94 to stop the conveyance of the paper P by the conveyer 4, processing for controlling the carriage motor 25 through the ASIC 94 to stop the scan operation and processing for controlling a notification device (unillustrated) through the ASIC 94 to output a notification to a user.

Although, as described previously, the input setting values determined in S8 to S10 may be slightly different from the input reference values x1 to x3 of FIG. 6 depending on the type of paper P, the magnitude relationship of the PWM values is the same as that of the input reference values x1 to x3. That is, the input setting value for the side edge detection is larger than the input setting value for the distance detection and the input setting value for the leading edge detection, and the input setting value for the leading edge detection is larger than the input setting value for the distance detection. The input-output characteristic of the optical sensor 7 is constant regardless of the type of paper P (which is the same as in FIG. 6). Hence, the PWM value of the input signal is determined for each of the leading edge detection, the side edge detection and the distance detection, and thus regardless of the type of paper P, a requirement is satisfied in which "the amount of change (D1) in the output signal with respect to change in the paper-nozzle distance in the distance detection is larger than the amount of change (D2, D3) in the existence detection (the leading edge detection and the side edge detection)". Specifically, the CPU 91 controls the light emission element 7*a* through the ASIC 94 such that the amount of light emitted in the distance detection is smaller than the amount of light emitted in the existence detection, and thus the amount of change in the distance detection is larger than the amount of change in the existence detection.

After S24, the CPU 91 determines whether recording on the paper P is finished (S25). When the image data which has not been recorded yet is left in the RAM 93, the CPU 91 determines that the recording on the paper P is not finished (S25: NO) and returns the process to S22. When the image data which has not been recorded yet is not left in the RAM 93, the CPU 91 determines that the recording on the paper P is finished (S25: YES) and ends the routine.

When the received recording command does not indicate the "borderless recording" (that is, the received recording command indicates the "margined recording" (S21: NO), the CPU 91 controls the conveyance motor 45 through the ASIC 94 to perform the conveyance operation for conveying the paper P by the particular amount in the conveyance direction (S26).

After S26, the CPU 91 controls the head driver 15 and the carriage motor 25 through the ASIC 94 to perform the scan operation for ejecting the ink from the nozzle 11*n* while moving the carriage 2 in the scan direction (S27). In S27, the CPU 91 performs the distance detection while performing control such that the scan operation is performed.

After S27, the CPU 91 determines whether the recording on the paper P is finished (S28). When the image data which has not been recorded yet is left in the RAM 93, the CPU 91 determines that the recording on the paper P is not finished (S28: NO) and returns the process to S26. When the image data which has not been recorded yet is not left in the RAM 93, the CPU 91 determines that the recording on the paper P is finished (S28: YES) and ends the routine.

As described above, in the present embodiment, the amount of change (D1) in the output signal with respect to change in the paper-nozzle distance in the distance detection is larger than the amount of change (D2, D3) in the existence detection (the leading edge detection and the side edge detection) (see FIG. 6). Hence, in the distance detection, as compared with the existence detection, a change in the paper-nozzle distance is finely detected. In this way, both the existence detection and the distance detection are accurately performed with the optical sensor 7.

The CPU 91 controls the light emission element 7*a* through the ASIC 94 such that the amount of light emitted (in relation to the PWM value) in the distance detection is smaller than the amount of light emitted in the existence detection (see FIG. 6). In this case, by relatively simple control, the effect described above (that is, the effect of "both the existence detection and the distance detection are accurately performed with the optical sensor 7") is obtained.

When the CPU 91 receives the recording command indicating the borderless recording (S21: YES), the CPU 91 performs the side edge detection at least during a certain period in the recording (S24, see FIG. 9). In the borderless recording, the side edge detection is important in terms of recording quality, and if no side edge detection is performed at all in the recording, the recording quality is remarkably degraded. In this regard, in the configuration described above, the side edge detection is performed at least during a certain period in the recording, and thus the degradation of the recording quality is suppressed.

When the CPU 91 receives the recording command indicating the borderless recording (S21: YES), the CPU 91 performs both the side edge detection and the distance detection (S24, see FIG. 9). In this way, both the degradation of the recording quality and the damage of the nozzle 11*n* caused by contact of the paper P with the nozzle surface 11*a* are suppressed.

When the CPU 91 receives the recording command indicating the borderless recording (S21: YES), the CPU 91 selects, for each scan of the scan operation, which one of the side edge detection and the distance detection is performed (S23, S24, see FIG. 9). If the side edge detection and the distance detection are switched in the middle of one scan, a problem in which the detection is not appropriately performed occurs due to a delay in electrical signals between the CPU 91, the ASIC 94 and the optical sensor 7. In this regard, in the configuration described above, the side edge detection and the distance detection are not switched in the middle of one scan, and selection is made for each scan as to which one of the side edge detection and the distance detection is performed, whereby the problem described above is suppressed.

The optical sensor 7 is mounted on the carriage 2 (see FIGS. 1 and 3). Thus, the existence detection and the distance detection are accurately performed.

When the CPU 91 receives the recording command indicating the margined recording (S21: NO), the CPU 91 performs the distance detection at least during a certain period in the recording (S27). Thus, in the margined recording, the damage of the nozzle 11*n* caused by contact of the paper P with the nozzle surface 11*a* is suppressed.

Before the recording (S11) of the image on the paper P based on the recording command, the CPU 91 performs the processing (S8, S9 (the first determination processing) and S10 (the second determination processing)) for determining the input setting values for the existence detection and the distance detection. Depending on the type of paper P, even when the input signals are the same, the output signals can be different. In this regard, in the configuration described above, the first determination processing and the second determination processing are performed before the recording, and thus the input setting values are set appropriate for the paper P. Thus, the accuracy of both the existence detection and the distance detection is enhanced.

Before the recording (S11) of the image on one paper P, the CPU 91 determines whether a difference between the ambient temperature indicated by the temperature signal from the temperature sensor 8 at this time and the ambient temperature indicated by the temperature signal from the temperature sensor 8 received most recently in S10 is larger than or equal to the particular temperature (S13). When the difference between the ambient temperatures is larger than or equal to the particular temperature (S13: YES), the CPU 91 returns the process to S6 so as to perform the processing for determining the input setting value for the distance detection (S10: the second determination processing). For example, when the ambient temperature is increased, even when the PWM value of the input signal is the same, the A/D value of the output signal is increased, with the result that the accuracy of the distance detection in particular is degraded. In this regard, in the configuration described above, the problem in which the accuracy of the distance detection is degraded by a variation in the ambient temperature is suppressed.

Before the recording (S11) of the image on one paper P, the CPU 91 determines whether the difference between the A/D value of the output signal received this time and the A/D value of an output signal received at the previous time is larger than or equal to the particular value (S14). When the difference between the A/D values is larger than or equal to the particular value (S14: YES), the CPU 91 returns the process to S6, and performs the processing (S8, S9 (the first determination processing) and S10 (the second determination processing)) for determining the input setting values for the existence detection and the distance detection. As described above, when the A/D value of the output signal is deviated by any factor, the input setting values are determined again so as to be set appropriate for the paper P. In this way, the accuracy of both the existence detection and the distance detection is satisfactorily maintained.

In S7, the CPU 91 disposes the carriage 2 at the position (see FIG. 1) at which the optical sensor 7 faces the mountain portion Px. The CPU 91 controls the light emission element 7*a* to irradiate light to the mountain portion Px in the paper P, and, based on the output signal received from the light reception element 7*b*, performs S8, S9 (the first determination processing) and S10 (the second determination processing). Since a part between the mountain portion Px and the valley portion Py in the paper P is unstable in shape, it is likely that light reflected off the part is not appropriately received by the light reception element 7*b*. In this regard, in the configuration described above, light reflected off the mountain portion Px whose shape is stable is appropriately received by the light reception element 7*b*.

Second Embodiment

Figure 10:
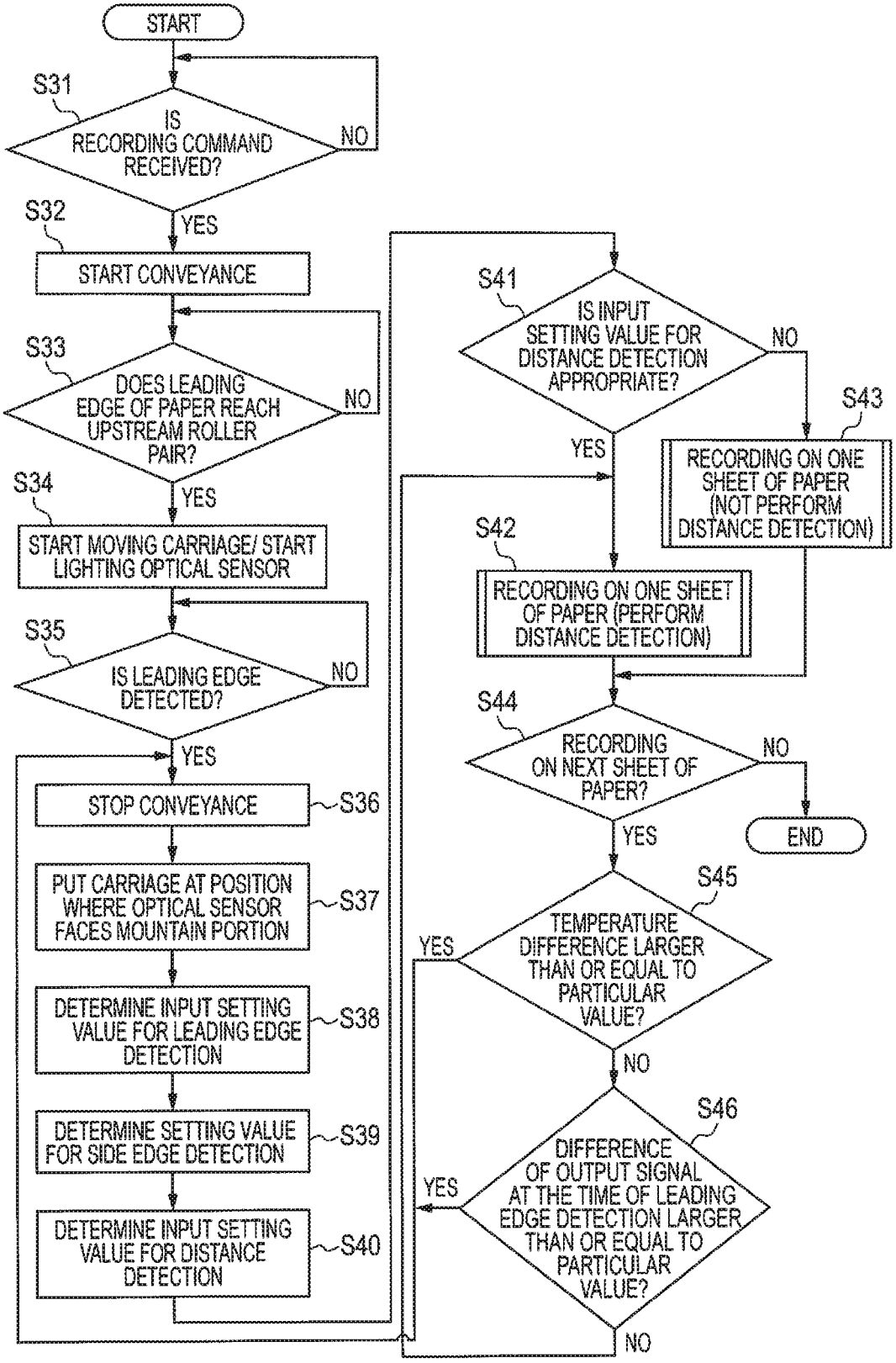
FIG. 10 is a flowchart showing control details relating to recording in a second embodiment of this disclosure.

Next, a second embodiment of this disclosure will be described with reference to FIG. 10. The printer of the second embodiment has the same configuration as the printer 100 of the first embodiment except that control details relating to recording are different from those of the printer 100 of the first embodiment.

In the first embodiment, after the input setting value for the distance detection is determined in S10, the CPU 91 proceeds with the process without determining whether the determined input setting value for the distance detection is appropriate. However, for example, when there is a part of the surface of the paper P to which a foreign matter (such as ink, toner or greasy dirt) is adhered, light is irradiated to the part from the light emission element 7*a*, the input setting value for the distance detection is determined and the distance detection is performed by use of this input setting value, with the result that an error occurs in the result of the distance detection for parts other than the part on the surface of the paper P. For example, when the optical sensor 7 has the properties shown in FIG. 6, and the height of the surface of the paper P is constant, the A/D value of an output signal obtained by irradiating light from the light emission element 7*a* to a part of the surface of the white paper P to which a color ink is adhered is smaller than the A/D value of an output signal obtained by irradiating light from the light emission element 7*a* to a part of the surface of the white paper P to which the ink is not adhered. Hence, when the input setting value for the distance detection is determined by irradiating light from the light emission element 7*a* to the part of the surface of the white paper P to which the color ink is adhered, and the distance detection is performed by use of this input setting value, although the paper-nozzle distance is within an allowable range, the A/D value of the output signal obtained by performing the distance detection on the part of the surface of the white paper P to which the ink is not adhered may exceed the threshold. In this case, it is likely that image recording is interrupted and that thus the throughput is decreased.

Hence, in the present embodiment, before image recording on the paper P and after the determination of the input setting value for the distance detection, the CPU 91 determines whether the determined input setting value for the distance detection is appropriate, and if the CPU 91 determines that the input setting value for the distance detection is appropriate, the distance detection is performed during recording the image on the paper P, whereas, if the CPU 91 determines that the input setting value for the distance detection is inappropriate, the distance detection is not performed during recording the image on the paper P.

Specifically, the CPU 91 first performs the same processing in S31 to S40 as in S1 to S10. After S40, the CPU 91 determines whether the input setting value for the distance detection determined in S40 is appropriate (S41).

In S41, for example, the CPU 91 disposes the light emission element 7*a* such that the light emission element 7*a* faces the surface of the paper P, and moves the carriage 2 in the scan direction while irradiating light from the light emission element 7*a*. Then, when the amount of increase in the A/D value of the output signal in one scan exceeds a particular amount, the CPU 91 determines that the determined input setting value for the distance detection is inappropriate (S41: NO). On the other hand, when the amount of increase in the A/D value of the output signal in one scan does not exceed the particular amount, the CPU 91 determines that the determined input setting value for the distance detection is appropriate (S41: YES).

When the input setting value for the distance detection determined in S40 is appropriate (S41: YES), as in S11, the CPU 91 controls each part of the printer 100 to perform the recording on one paper P (S42). As shown in FIGS. 8 and 9, in S42, the CPU 91 performs the distance detection.

When the input setting value for the distance detection determined in S40 is inappropriate (S41: NO), the CPU 91 does not perform the distance detection and controls each part of the printer 100 to perform the recording on one paper P (S43). In S43, the CPU 91 may perform the side edge detection but does not perform the distance detection.

After S42 or S43, the CPU 91 performs the same processing in S44 to S46 as in S12 to S14. Then, when the CPU 91 determines that the recording on the subsequent paper P is not necessary (S44: NO), the CPU 91 ends the routine.

As described above, according to the present embodiment, not only the same effects obtained in the same configuration as in the first embodiment but also the following effect is obtained. Specifically, when the determined input setting value for the distance detection is inappropriate, the problem is suppressed that an error occurs in the result of the distance detection and that image recording is interrupted.

Third Embodiment

Figure 11:
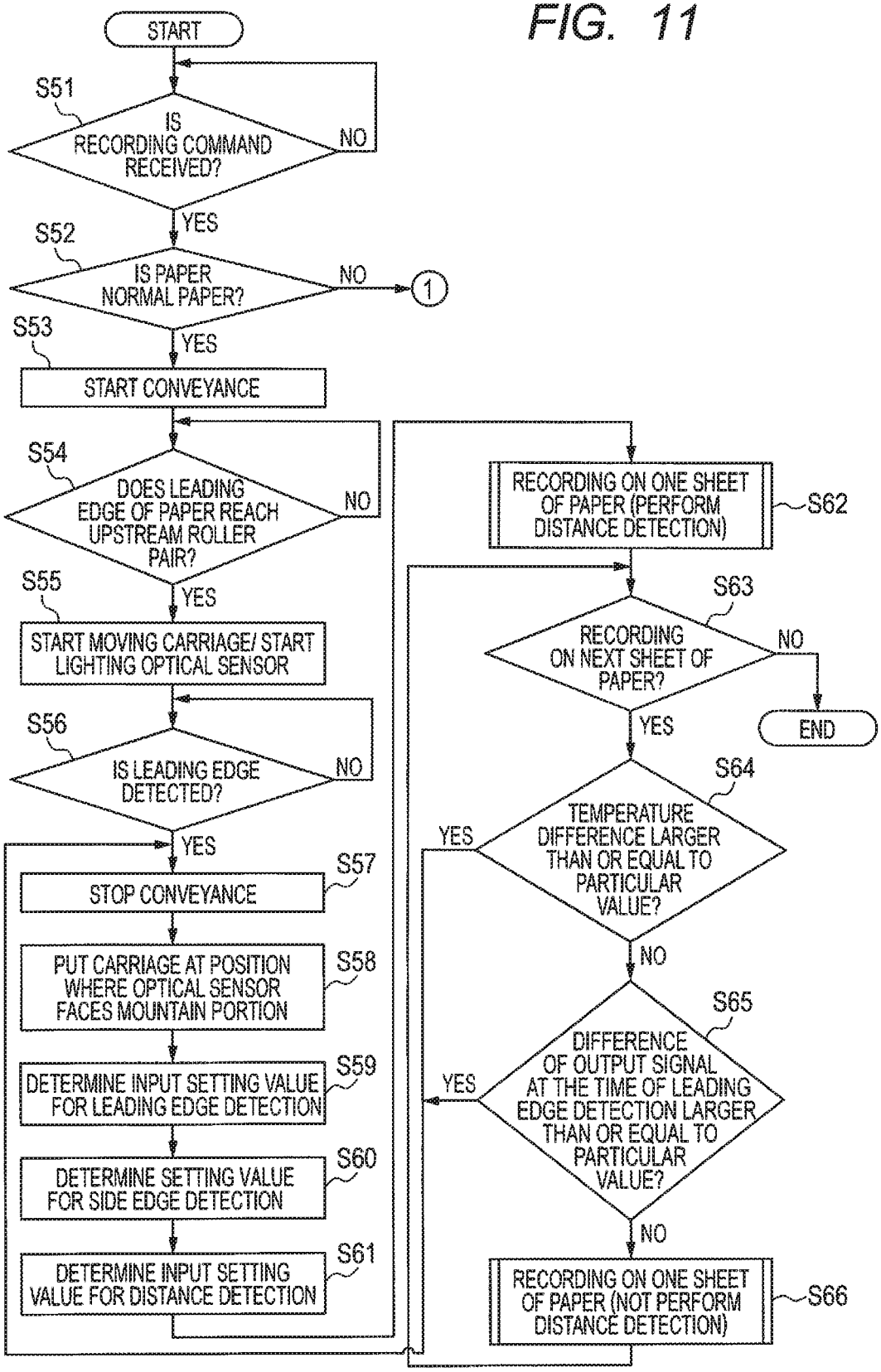
FIG. 11 is a flowchart showing control details relating to recording in a third embodiment of this disclosure.

Next, a third embodiment of this disclosure will be described with reference to FIG. 11. The printer of the third embodiment has the same configuration as the printer 100 of the first embodiment except that control details relating to recording are different from those of the printer 100 of the first embodiment.

Figure 7:
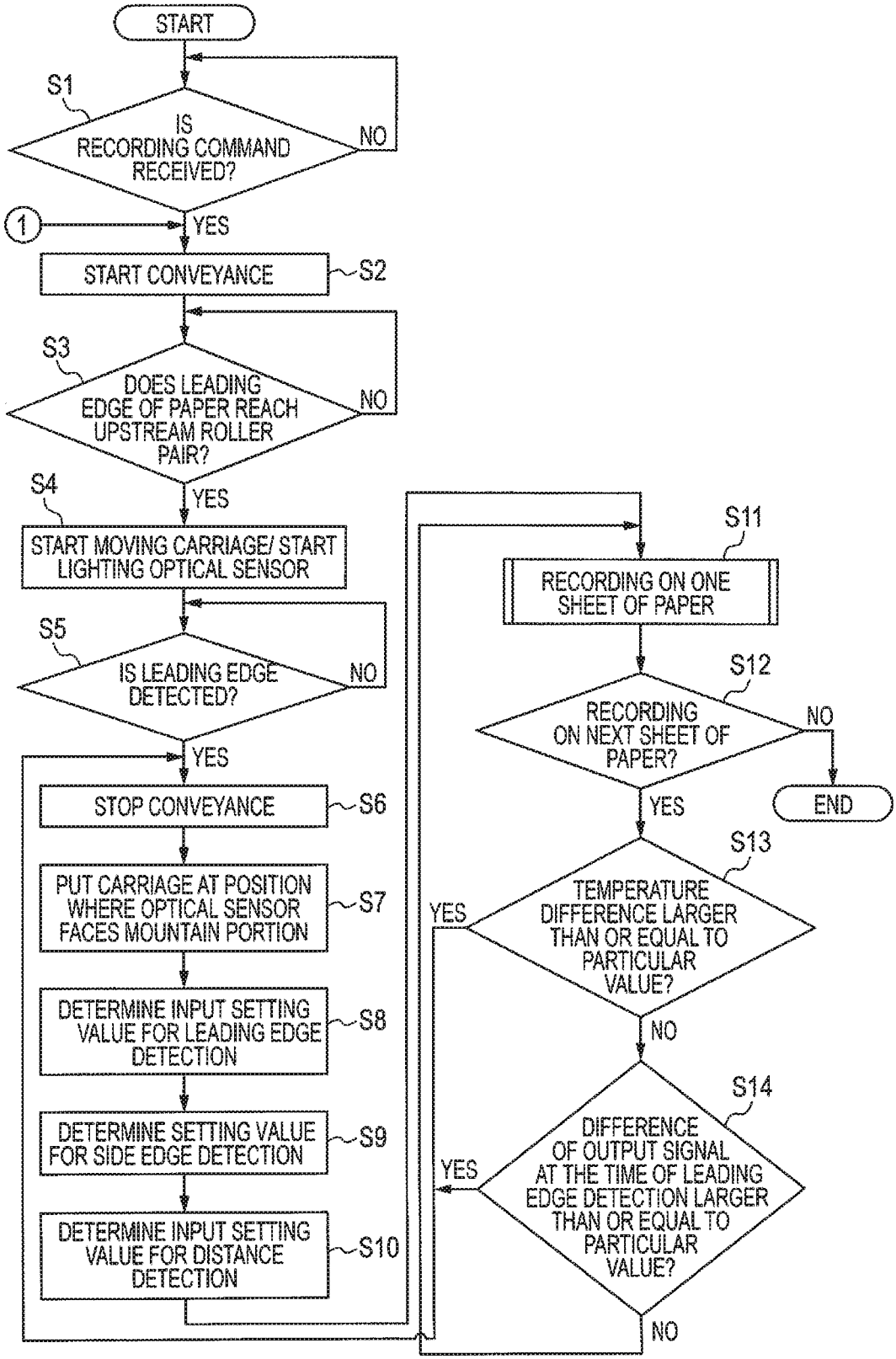
FIG. 7 is a flowchart showing control details relating to recording in the first embodiment of this disclosure.

In the first embodiment, the CPU 91 uniformly performs the processing shown in FIG. 7 regardless of the type of paper P. However, depending on the type of paper P, the reliability of the distance detection is lowered. For example, with normal paper, as compared with gloss paper and so on, the conveyance speed is high, and the reliability of the distance detection is low. In other words, with gloss paper and so on, as compared with normal paper, the reliability of the distance detection is high. That is, normal paper corresponds to a "first type", and gloss paper and so on (sheets other than normal paper) correspond to a "second type". It takes some time to perform the processing (S8 to S10 in the first embodiment) for determining the input setting value. Hence, if the CPU 91 uniformly performs the processing for determining the input setting value before image recording on the paper P regardless of the type of paper P, loss of time occurs, with the result that it is difficult to realize high-speed recording.

Hence, in the present embodiment, the CPU 91 determines whether the paper P is normal paper, and when the image is continuously recorded on a plurality of sheets of normal paper, if particular conditions are satisfied before the image is recorded on the second and subsequent sheets of normal paper, the processing for determining the input setting value is not performed before image recording on the second and subsequent sheets of normal paper, and the distance detection is not performed when the image is recorded on the second and subsequent sheets of normal paper.

Specifically, the CPU 91 first performs the same processing in S51 as in S1. Then, when the recording command is received (S51: YES), the CPU 91 determines whether the paper P is normal paper (S52). When the paper P is not normal paper (for example, gloss paper and so on) (S52: NO), the CPU 91 moves the processing to S2 in FIG. 7, and the same processing as in the first embodiment is performed.

When the paper P is normal paper (S52: YES), the CPU 91 performs the same processing in S53 to S65 as in S2 to S14. In S62, as in S11, the CPU 91 performs the distance detection (see FIGS. 8 and 9). Then, when the CPU 91 determines that the recording on the subsequent paper P is necessary (S63: YES), the difference between the ambient temperatures is not larger than or equal to the particular temperature (S64: NO), and the difference between the A/D values at the time of the leading edge detection is not larger than or equal to the particular value (S65: NO), the CPU 91 does not perform the processing (S59 to S61) for determining the input setting value before image recording on the subsequent paper P, and controls each part of the printer 100 to perform the recording on the subsequent paper P without performing the distance detection (S66). In S66, the CPU 91 may perform the side edge detection but does not perform the distance detection. After S66, the CPU 91 returns the process to S63.

In the present embodiment, a condition in which the difference between the ambient temperatures is not larger than or equal to the particular temperature (S64: NO) and a condition in which the difference between the A/D values at the time of the leading edge detection is not larger than or equal to the particular value (S65: NO) are examples of the "particular condition".

As described above, according to the present embodiment, not only the same effects obtained in the same configuration as in the first embodiment but also the following effect is obtained. Specifically, when the paper P is the type of paper in which the reliability of the distance detection is low as with normal paper, the processing (S59 to S61) for determining the input setting value before image recording on the second and subsequent sheets P is omitted, and thus loss of time is reduced, with the result that high-speed recording is realized. In the case described above, the distance detection is not performed when the image is recorded on the second and subsequent sheets P (S66), and thus the problem is suppressed that image recording is interrupted by the result of detection whose reliability is low.

The CPU 91 may determine whether to interrupt image recording based on a decrease in the movement speed of the carriage 2 instead of the result of the distance detection. Specifically, the CPU 91 may detect, based on the signal from the carriage motor 25, a decrease in the movement speed of the carriage 2 in one scan, and when the decrease in the movement speed is larger than or equal to a certain value, the CPU 91 may determine that the paper P has made contact with the nozzle surface 11*a* and interrupt recording of the image. In particular, when the distance detection is not performed during recording of the image on the paper P in the second and third embodiments, by interrupting recording of the image based on the decrease in the movement speed of the carriage 2, the damage of the nozzle 11*n* caused by contact of the paper P with the nozzle surface 11*a* is suppressed.

Modification

While the disclosure has been described in detail with reference to the above aspects thereof, it would be apparent to those skilled in the art that various changes and modifications may be made therein without departing from the scope of the claims.

In the above-described embodiment, the optical sensor is disposed upstream of all nozzles formed on the nozzle surface in the conveyance direction, however, the disposition is not limited to this. For example, a part of the nozzles formed on the nozzle surface may be disposed upstream of the optical sensor in the conveyance direction. In addition, the optical sensor is not limited to being mounted on the carriage, and may be disposed on the nozzle surface of the head.

The characteristics of the optical sensor are not limited to those shown in FIG. 6. For example, in FIG. 6, the A/D value of the output signal becomes smaller as the paper-nozzle distance becomes longer, however, the A/D value may become larger as the paper-nozzle distance becomes longer. In the embodiment described above, the A/D value of the output signal changes according to the paper-nozzle distance, however, without limiting to this, an arbitrary element (for example, wavelength) of the output signal may change according to the paper-nozzle distance. In this case, the controller may detect the paper-nozzle distance based on a change of the above-described element of the output signal. The output signal may include data quantifying the paper-nozzle distance.

In the above-described embodiments, in order to satisfy the requirement that "the amount of change in the output signal with respect to change in the paper-nozzle distance in the distance detection is larger than the amount of change in the existence detection", the amount of light emitted in the distance detection is set lower than the amount of light emitted in the existence detection. However, the configuration is not limited to this, and a change may be made as necessary according to the properties of each optical sensor. In the above-described embodiments, in order to satisfy the requirement described above, the amount of light emitted is adjusted. However, the amount of light received or the output signal may be adjusted or both the amount of light received and the output signal may be adjusted. In the above-described embodiments, the PWM value is used as the parameter for the value of the input signal, and the A/D value is used as the parameter for the amount of change in the output signal and the reference value. However, the parameters are not limited to these parameters.

The optical sensor is not limited to one in number. For example, when the liquid ejection head ejects liquids in a plurality of colors, the optical sensor may be provided for each color. In this case, the value of the input signal may be changed for each optical sensor, and a certain optical sensor may be used to perform the existence detection, and another optical sensor may be used to perform the distance detection.

In the borderless recording, in the first embodiment (FIGS. 8 and 9), both the side edge detection and the distance detection are performed. However, the distance detection may not be performed. In the first embodiment, by using the serial-type head, selection is made for each scan as to which one of the side edge detection and the distance detection is performed. However, the configuration is not limited to this, and the side edge detection and the distance detection may be switched in the middle of one scan. For example, the side edge detection may be performed when the carriage exists in the vicinity of one end and the other end of the movable range thereof in the scan direction, and the distance detection may be performed when the carriage exists at the other positions.

In the margined recording, not only the distance detection but also the side edge detection may be performed.

The sequence of performing the first determination processing and the second determination processing is not particularly limited. For example, after the second determination processing is performed, the first determination processing may be performed.

In the above-described embodiments, in the first determination processing and the second determination processing, light is irradiated to the mountain portion. However, light may be irradiated to the valley portion. In the above-described embodiments, a plurality of mountain portions is formed. However, at least one mountain portion may be formed.

In the above-described embodiments, the first determination processing and the second determination processing are performed when the difference between the ambient temperatures is larger than or equal to the particular temperature. However, the first determination processing may not be performed.

It takes some time to perform the first determination processing and the second determination processing. Hence, in order to reduce loss of time, when the image is continuously recorded on a plurality of ejection targets, it is preferable that the first determination processing and/or the second determination processing be not performed each time the recording is performed on one ejection target, and the first determination processing and/or the second determination processing be performed only before image recording on the first ejection target (that is, the first determination processing and/or the second determination processing is not performed before image recording on the second and subsequent ejection targets), or it is preferable that the first determination processing and/or the second determination processing be performed only when it is highly likely that the type of ejection target is changed. Instead of performing the first determination processing and the second determination processing, the threshold (value used for a determination as to whether to interrupt image recording) may be changed.

The method of determining whether the second input setting value is appropriate is not limited to the method described in the second embodiment. For example, the controller may read, with an image reading device, a part of the ejection target to which light is irradiated in the second determination processing, may determine that the second input setting value is appropriate when a foreign matter such as ink is not adhered to the part, and may determine that the second input setting value is inappropriate when a foreign matter such as ink is adhered to the part.

When the image is continuously recorded on the ejection target that is the first type, the second determination processing may not be performed before recording the image on the first ejection target among a plurality of ejection targets, and the distance detection may not be performed when the image is recorded on the first ejection target.

The temperature sensor may be arranged in an arbitrary position as long as the temperature signal indicating the ambient temperature around the head is output. For example, the temperature sensor may be arranged on the circuit board of the controller. In this case, the temperature indicated by the temperature signal output from the temperature sensor may be corrected to acquire the ambient temperature around the head.

In the above-described embodiments, the leading edge detection and the side edge detection are performed as the existence detection. However, only one of the leading edge detection and the side edge detection may be performed.

In the above-described embodiment, the CPU and the ASIC share the function of the controller, but is not limited to this. For example, only one of the CPU and ASIC may function as the controller, or a plurality of CPUs and/or a plurality of ASICs may share the function of the controller.

The memory is not limited to a ROM, and may by an EEPROM, a flash memory, and so on.

The conveyer is not limited to roller pairs, but may include a belt to support the ejection target medium. The conveyance direction is linear in the embodiment described above, but may be curved.

The liquid ejection head is not limited to a serial type, but may be a line type (that is, a type that ejects a liquid to a recording medium while being fixed in position). When the liquid ejection head is a line type, an optical sensor elongated in the scan direction or a plurality of sensors away from each other in the scan direction may be provided, or a carriage for moving one optical sensor in the scan direction may be provided. When the line-type head is used, during the recording, the value of the input signal may be changed depending on the amount of conveyance of the ejection target, such that the side edge detection and the distance detection are switched. Alternatively, with the plurality of optical sensors separate from each other in the scan direction, the optical sensors in the vicinity of one end and the other end in the scan direction may perform the side edge detection, and the other optical sensors may perform the distance detection. Moreover, alternatively, when one optical sensor is moved in the scan direction, the side edge detection may be performed when the optical sensor exists in the vicinity of one end and the other end of the movable range thereof in the scan direction, and the distance detection may be performed when the optical sensor exists at the other positions.

As an actuator to provide an energy to eject a liquid from the nozzles, a piezoelectric type is exemplified in the embodiment described above, however, without limiting to this, other types (for example, a thermal type using a heating element, an electrostatic type using an electrostatic force, and so on) may be used.

A liquid to be ejected from the nozzles is not limited to a dye ink, but may be a pigment ink. When a liquid to be ejected from the nozzles is a pigment ink, for example, preferably, a plurality of light emission elements that emit lights of mutually different colors are provided, and in distance detection, a light emission element that emits light in a color opposite to a color of the ink in a hue circle is selected among the plurality of light emission elements, and from this light emission element, light is irradiated onto the surface of the ejection target. This suppresses a problem in which a difference in reflected light amount between a region in which the ink has landed and a region in which the ink has not landed on the surface of the ejection target increases. The liquid to be ejected from the nozzles is not limited to ink, but may be an arbitrary liquid (for example, a processing liquid that aggregates or precipitates components in the ink, and so on).

The ejection target is not limited to a sheet of paper, but may be, for example, cloth or an electronic substrate (base material to form a flexible printed board, and so on). In the third embodiment, normal paper is shown as the first type of ejection target, and gloss paper and so on (sheets other than normal paper) are shown as the second type of ejection target. The ejection target is not limited to these. For example, by using thickness of the paper as a reference, thin paper may be set as the first type, and thick paper whose thickness is greater than thin paper may be set as the second type.

This disclosure is applicable not only to a printer but also to a facsimile machine, a copying machine, a multifunction peripheral, and so on. This disclosure is also applied to a liquid ejection apparatus (for example, a liquid ejection apparatus which ejects an electrically conductive liquid to a board or substrate so as to form an electrically conductive pattern) which is used for applications other than the recording of an image.

What is claimed is:

1. A liquid ejection apparatus comprising:

a liquid ejection head having a nozzle surface formed with a nozzle configured to eject liquid;

a conveyer configured to convey an ejection target in a conveyance direction along a conveyance path including a facing position facing the nozzle surface;

an optical sensor including a light emission element configured to emit light and a light reception element configured to output an output signal based on received light; and a controller configured to receive the output signal outputted from the light reception element, the controller configured to change a light emission amount emitted by the light emission element, and the controller being configured to perform:

an edge detection of controlling the light emission element to emit light at a first light emission amount, and detecting whether an edge of the ejection target exists at the facing position based on the output signal; and a distance detection of controlling the light emission element to emit light at a second light emission amount toward a surface of the ejection target and detecting a distance between the surface of the ejection target and the nozzle surface based on the output signal outputted from the light reception element upon receiving light reflected off the surface of the ejection target, the second light emission amount being smaller than the first light emission amount, an amount of change of the output signal with respect to change of the distance in the distance detection being larger than an amount of change of the output signal with respect to change of the distance in the edge detection.

2. The liquid ejection apparatus according to claim 1, wherein the conveyer is configured to convey the ejection target in the conveyance direction; and wherein the controller is configured to, in response to receiving a recording command indicative of borderless recording of recording an image by ejecting liquid from the nozzle in a region including the edge of the ejection target in a perpendicular direction perpendicular to the conveyance direction, perform the edge detection of detecting whether the edge exists at the facing position in a certain period during recording an image on the ejection target based on the recording command.

3. The liquid ejection apparatus according to claim 2, wherein the controller is configured to, in response to receiving a recording command indicative of the borderless recording, perform both the edge detection and the distance detection during the recording.

4. The liquid ejection apparatus according to claim 3, further comprising a carriage on which the liquid ejection head is mounted, wherein the controller is configured to:

during recording, alternately perform: a conveyance operation of controlling the conveyer to convey the ejection target by a particular amount in the conveyance direction; and a scan operation of ejecting liquid from the nozzle while moving the carriage in the perpendicular direction; and selecting which one of the edge detection and the distance detection is to be performed for each scan of the scan operation.

5. The liquid ejection apparatus according to claim 4, wherein the optical sensor is mounted on the carriage.

6. The liquid ejection apparatus according to claim 2, wherein the controller is configured to:

in response to receiving a recording command indicative of the borderless recording, perform both the edge detection and the distance detection during the recording; and in response to receiving a recording command indicative of margined recording, perform the distance detection during the recording without performing the edge detection, the margined recording being such recording that a margin is provided in a region including the edge of the ejection target in the perpendicular direction and that an image is not recorded in the margin.

7. The liquid ejection apparatus according to claim 1, wherein the conveyer is configured to convey the ejection target in the conveyance direction; and wherein the controller is configured to, in response to receiving a recording command indicative of margined recording of providing a margin in a region including the edge of the ejection target in a perpendicular direction perpendicular to the conveyance direction, perform the distance detection in a certain period during recording an image on the ejection target based on the recording command.

8. The liquid ejection apparatus according to claim 1, further comprising a memory configured to store:

a first output reference value that is a reference value of the output signal for the edge detection; and a second output reference value that is a reference value of the output signal for the distance detection, wherein the controller is configured to, before recording an image on the ejection target by ejecting liquid from the nozzle based on a recording command:

control the conveyer to convey the ejection target, input an input signal to the light emission element to cause the light emission element to emit light toward the surface of the ejection target, and receive the output signal from the light reception element;

perform a first determination processing of determining, as a first input setting value, a value of the input signal when a value of the received output signal is the first output reference value, the first input setting value being a setting value of the input signal used for the edge detection; and perform a second determination processing of determining, as a second input setting value, a value of the input signal when a value of the received output signal is the second output reference value, the second input setting value being a setting value of the input signal used for the distance detection.

9. The liquid ejection apparatus according to claim 8, further comprising a temperature sensor configured to output, to the controller, a temperature signal indicative of an ambient temperature, wherein the controller is configured to, before recording an image on one ejection target, determine whether a difference between the ambient temperature indicated by the temperature signal and the ambient temperature under a condition that the second determination processing is performed most recently is larger than or equal to a particular temperature; and under a condition that the difference of the ambient temperature is larger than or equal to the particular temperature, perform the second determination processing.

10. The liquid ejection apparatus according to claim 8, wherein the controller is configured to, before recording an image on one ejection target:

determine whether a difference between a first value and a second value is larger than or equal to a particular value, the first value being a value of the output signal received when it is detected that the one ejection target exists at the facing position during the edge detection for the one ejection target, the second value being a value of the output signal received when it is detected that a previous ejection target exists at the facing position during the edge detection for the previous ejection target that is recorded most recently; and under a condition that the difference of the output signal is larger than or equal to the particular value, perform the first determination processing and the second determination processing.

11. The liquid ejection apparatus according to claim 8, wherein the conveyer is configured to convey the ejection target in the conveyance direction;

wherein the liquid ejection apparatus further comprises a wave-shape imparting mechanism configured to impart a wave shape to the ejection target, the wave shape including a mountain portion close to the nozzle surface and a valley portion farther away from the nozzle surface than the mountain portion is, the mountain portion and the valley portion being arranged in a perpendicular direction perpendicular to the conveyance direction; and wherein the controller is configured to:

emit light from the light emission element toward one of the mountain portion and the valley portion; and based on the output signal received from the light reception element, perform the first determination processing and the second determination processing.

12. The liquid ejection apparatus according to claim 8, wherein the controller is configured to:

determine whether an amount of increase in a value of the output signal in one scan exceeds a particular amount, at a timing before recording an image on the ejection target and after performing the second determination processing;

in response to determining that the amount of increase in the value of the output signal in one scan does not exceed the particular amount, perform the distance detection during recording an image on the ejection target; and in response to determining that the amount of increase in the value of the output signal in one scan exceeds the particular amount, not perform the distance detection during recording an image on the ejection target.

13. The liquid ejection apparatus according to claim 8, wherein the controller is configured to:

change a conveyance speed of the ejection target depending on a type of the ejection target;

determine whether the ejection target is a first type or a second type, the conveyance speed of the ejection target of the first type being higher than the conveyance speed of the ejection target of the second type; and under a condition that an image is recorded continuously on a plurality of ejection targets that is determined to be the first type and a particular condition is satisfied before recording an image on second and subsequent ejection targets of the plurality of ejection targets, not perform the second determination processing before recording an image on the second and subsequent ejection targets and not perform the distance detection during recording an image on the second and subsequent ejection targets.

14. The liquid ejection apparatus according to claim 1, wherein the controller is further configured to perform at least one of:

detecting whether a leading edge of the ejection target exists at the facing position, the leading edge being a downstream edge of the ejection target in the conveyance direction; and detecting whether a side edge of the ejection target exists at the facing position, the side edge being an edge of the ejection target in a perpendicular direction to the conveyance direction.

15. The liquid ejection apparatus according to claim 1, wherein the controller is further configured to:

increase the light emission amount for reducing a sensitivity, the sensitivity being an amount of change of the output signal with respect to change of the distance; and reduce the light emission amount for increasing the sensitivity.

16. A liquid ejection apparatus comprising:

a liquid ejection head having a nozzle surface formed with a nozzle configured to eject liquid;

a carriage on which the liquid ejection head is mounted;

a conveyer configured to convey an ejection target in a conveyance direction along a conveyance path including a facing position facing the nozzle surface, wherein the conveyer is configured to convey the ejection target in the conveyance direction;

an optical sensor including a light emission element configured to emit light and a light reception element configured to output an output signal based on received light; and a controller configured to receive the output signal outputted from the light reception element, the controller being configured to perform:

an existence detection of controlling the light emission element to emit light and detecting whether the ejection target exists at the facing position based on the output signal;

a distance detection of controlling the light emission element to emit light toward a surface of the ejection target and detecting a distance between the surface of the ejection target and the nozzle surface based on the output signal outputted from the light reception element upon receiving light reflected off the surface of the ejection target, an amount of change of the output signal with respect to change of the distance in the distance detection being larger than an amount of change of the output signal with respect to change of the distance in the existence detection;

in response to receiving a recording command indicative of borderless recording of recording an image by ejecting liquid from the nozzle in a region including an edge of the ejection target in a perpendicular direction perpendicular to the conveyance direction, perform an edge detection of detecting whether the edge exists at the facing position in a certain period during recording an image on the ejection target based on the recording command, the edge detection being included in the existence detection;

in response to receiving a recording command indicative of the borderless recording, perform both the edge detection and the distance detection during the recording;

during recording, alternately perform: a conveyance operation of controlling the conveyer to convey the ejection target by a particular amount in the conveyance direction; and a scan operation of ejecting liquid from the nozzle while moving the carriage in the perpendicular direction; and selecting which one of the edge detection and the distance detection is to be performed for each scan of the scan operation.

17. A liquid ejection apparatus comprising:

a liquid ejection head having a nozzle surface formed with a nozzle configured to eject liquid;

a conveyer configured to convey an ejection target in a conveyance direction along a conveyance path including a facing position facing the nozzle surface, wherein the conveyer is configured to convey the ejection target in the conveyance direction;

an optical sensor including a light emission element configured to emit light and a light reception element configured to output an output signal based on received light; and a controller configured to receive the output signal outputted from the light reception element, the controller being configured to perform:

an existence detection of controlling the light emission element to emit light and detecting whether the ejection target exists at the facing position based on the output signal;

a distance detection of controlling the light emission element to emit light toward a surface of the ejection target and detecting a distance between the surface of the ejection target and the nozzle surface based on the output signal outputted from the light reception element upon receiving light reflected off the surface of the ejection target, an amount of change of the output signal with respect to change of the distance in the distance detection being larger than an amount of change of the output signal with respect to change of the distance in the existence detection; and in response to receiving a recording command indicative of margined recording of providing a margin in a region including an edge of the ejection target in a perpendicular direction perpendicular to the conveyance direction, perform the distance detection in a certain period during recording an image on the ejection target based on the recording command.

18. A liquid ejection apparatus comprising:

a liquid ejection head having a nozzle surface formed with a nozzle configured to eject liquid;

a conveyer configured to convey an ejection target in a conveyance direction along a conveyance path including a facing position facing the nozzle surface;

an optical sensor including a light emission element configured to emit light and a light reception element configured to output an output signal based on received light; and a memory configured to store:

a first output reference value that is a reference value of the output signal for the existence detection; and a second output reference value that is a reference value of the output signal for the distance detection;

a controller configured to receive the output signal outputted from the light reception element, the controller being configured to perform:

an existence detection of controlling the light emission element to emit light and detecting whether the ejection target exists at the facing position based on the output signal;

a distance detection controlling the light emission element to emit light toward a surface of the ejection target and detecting a distance between the surface of the ejection target and the nozzle surface based on the output signal outputted from the light reception element upon receiving light reflected off the surface of the ejection target, an amount of change of the output signal with respect to change of the distance in the distance detection being larger than an amount of change of the output signal with respect to change of the distance in the existence detection; and before recording an image on the ejection target by ejecting liquid from the nozzle based on a recording command, the controller is further configured to:

control the conveyer to convey the ejection target, input an input signal to the light emission element to cause the light emission element to emit light toward the surface of the ejection target, and receive the output signal from the light reception element;

perform a first determination processing of determining, as a first input setting value, a value of the input signal when a value of the received output signal is the first output reference value, the first input setting value being a setting value of the input signal used for the existence detection; and perform a second determination processing of determining, as a second input setting value, a value of the input signal when a value of the received output signal is the second output reference value, the second input setting value being a setting value of the input signal used for the distance detection.

* * * * *